US008581784B2

(12) United States Patent
Nagel

(10) Patent No.: US 8,581,784 B2
(45) Date of Patent: Nov. 12, 2013

(54) THZ ANTENNA ARRAY, SYSTEM AND METHOD FOR PRODUCING A THZ ANTENNA ARRAY

(75) Inventor: Michael Nagel, Viersen (DE)

(73) Assignee: Rwth Aachen University, Aachen (DE)

( * ) Notice: Subject to any disclaimer, the term of this patent is extended or adjusted under 35 U.S.C. 154(b) by 775 days.

(21) Appl. No.: 12/294,442

(22) PCT Filed: Mar. 29, 2007

(86) PCT No.: PCT/EP2007/002790

§ 371 (c)(1),
(2), (4) Date: Dec. 28, 2010

(87) PCT Pub. No.: WO2007/112925

PCT Pub. Date: Oct. 11, 2007

(65) Prior Publication Data

US 2011/0080329 A1 Apr. 7, 2011

(30) Foreign Application Priority Data

Mar. 29, 2006 (DE) ..... 10 2006 014 801

(51) Int. Cl.
*H01Q 1/38* (2006.01)
*H01Q 13/10* (2006.01)

(52) U.S. Cl.
USPC ..... 343/700 MS; 343/770; 343/853; 343/893

(58) Field of Classification Search
None
See application file for complete search history.

(56) References Cited

U.S. PATENT DOCUMENTS

| | | | |
|---|---|---|---|
| 5,401,953 | A | 3/1995 | Spencer et al. |
| 5,663,639 | A | 9/1997 | Brown et al. |
| 7,564,034 | B2 | 7/2009 | Ouchi |
| 7,609,208 | B2 | 10/2009 | Evans et al. |
| 2005/0215031 | A1 | 9/2005 | Ouchi |

FOREIGN PATENT DOCUMENTS

| | | | |
|---|---|---|---|
| EP | 1429431 | A1 | 6/2004 |
| JP | 2005311324 | A | 11/2005 |
| JP | 2005538542 | A | 12/2005 |
| JP | 2006064691 | A | 3/2006 |
| WO | 2004/023566 | A1 | 3/2004 |
| WO | 2004023566 | A1 | 3/2004 |
| WO | 2006011636 | A1 | 2/2006 |
| WO | 2006/047975 | A1 | 5/2006 |

OTHER PUBLICATIONS

A. Dreyhaupt et al.; Large-Area High-Power THz Emitter Based on Interdigitated Electrodes; Conference Digest of the 2004 Joint 29th International Conference on Infrared and Millimeter Waves and 12th International Conference on Terahertz Electronics, IEEE, Sep. 27, 2004, pp. 83-84.

A. Dreyhaupt et al., High-intensity terahertz radiation from a microstructured large-area photoconductor, XP-12064697, Applied Physics Letters 86, 121114 (Feb. 8, 2005), The American Institute of Physics.

(Continued)

*Primary Examiner* — Trinh Dinh
(74) *Attorney, Agent, or Firm* — Bachman & LaPointe, P.C.

(57) ABSTRACT

A THz antenna array has a plurality of THz antennae, a THz antenna having a photoconductive region and a first electrode and a second electrode which are arranged interspaced from each other via a spacer region that extends laterally across at least a part of the photoconductive region. In order to simplify the structure and facilitate its production, a lateral region between adjacent THz antennae of the array is not photoconductive. It is especially free from photoconductive material.

29 Claims, 8 Drawing Sheets

(56) References Cited

OTHER PUBLICATIONS

A. Dreyhaupt et al., Large-area high-power THz emitter based on interdigitated electrodes, IEEE 2004, Joint 29th Int. Conf. on Infrared and Millimeter Waves and 12th Int. Conf. on Terahertz Electronics, pp. 83-84.

E.R. Brown et al., Room Temperature, THz photomixing sweep oscillator and its application to spectrascopic transmission through organic materials, American Institute of Physics, Dec. 2004, Scientific Instruments, vol. 75, No. 12, pp. 5333-5342, University of California, Santa Barbara, CA.

Daryoosh Saeedkia et al., CW Photoconductive Photomixer/Antenna Array Source for THz Applications, IEEE 2004, publication No. 0/7803-8491-1/04, pp. 317-320, Department of Electrical and Computer Engineering, University of Waterloo, Waterloo, Ontario, Canada.

Jin-Wei Shi et al., Edge-coupled membrane terahertz photonic transmitters based on metal-semiconductor-metal traveling-wave photodetectors, American Institute of Physics, Dec. 30, 2002, Applied Physics Letters, vol. 81, No. 27, pp. 5108-5110.

Dreyhaupt A et al, "High-intensity terahertz radiation from a microstructured large-area photoconductor", Applied Physics Letters, AIP, American Institute of Physics, Mar. 17, 2005, vol. 86, No. 12.

German Search Report, dated Nov. 8, 2006.

PRIOR ART (Cross section)

Invention Type I (Cross section)

Invention Typ II (Cross section)

Invention Type I, Type II (Cross section)

THz Antenna Arrays before "epitaxiall lift-off"

Transferred THz Antenna Array on saphire substrate

Invention, Variation: Resonator elements (top view)

51 GaAs Substrate - starter material
52 AlAs sacrificial layer
53 LT GaAs
54 Electrodes finger structure
55 Array substrate (a) starter material
(b) structuring of electrodes
(c) LT-GaAs etching
(d) epitaxiall lift-off
(e) THz-Antenna array / substrate hybridization
(f) completed structure

THZ ANTENNA ARRAY, SYSTEM AND METHOD FOR PRODUCING A THZ ANTENNA ARRAY

RELATED APPLICATIONS

This application is a 371 of PCT/EP2007/002790 filed Mar. 29, 2007, which claims priority under 35 U.S.C. 119 from GERMANY 10 2006 014 801.0 filed on Mar. 29, 2006, the contents of which are incorporated herein by references.

BACKGROUND (1) Field of the Invention

The invention relates to a THz antenna array comprising a plurality of THz antennae, wherein a THz antenna has a photoconductive region and a first electrode and a second electrode which are arranged spaced apart from one another by a spacer region which extends laterally over at least a part of the photoconductive region. The invention further relates to a method for producing a THz antenna array comprising a plurality of THz antennae, wherein a THz antenna has a photoconductive region and a first electrode and a second electrode which are arranged spaced apart from one another by a spacer region which extends laterally over at least a part of the photoconductive region.

(2) Prior Art

THz antennae can be constructed and manufactured in different ways, it being possible to employ these inter alia as receivers and/or as transmitters.

A first fundamental form of a THz antenna provides a semilarge single antenna structure designed for the range between microscopically small structures (less than 100 μm) and macroscopic millimeter structures (>1 mm). Such a THz antenna is described by Stone et al. in the article "Electrical and Radiation Characteristics of Semilarge Photoconductive Terahertz Emitters" in IEEE TRANSACTIONS ON MICROWAVE THEORY AND TECHNIQUES, Vol. 52, No. 10, October 2004.

U.S. Pat. No. 5,401,953 discloses an integrated module for generating radiation in the submillimeter range, the module comprising an array of N photoconductive switches which are biased by a common voltage source and an optical path difference of a common optical pulse providing a repetition rate with different optical delay for each of the switches. The N switches are triggered by a pulse migrating along the entire array of N switches up to a single antenna which as a point source radiates submillimeter radiation spherically in all directions.

In contrast the THz antenna arrays of the type identified at the outset composed of a plurality of THz antennae or THz antenna structures exhibit improved power and modulatability of the same as well as improved directional characteristics. A THz antenna or THz antenna structure fundamentally comprises two electrodes spaced apart with an intervening photoconductive material, i.e. usually a region containing semiconductive material in which charge carriers are optically generable. At the same time the individual THz antennae or THz antenna structures usually have microscopic dimensions. A problem with this is the decoupling of the individual THz antennae as elements of the array in order to prevent destructive interference of the THz distant field—as a rule, e.g. in finger structures, neighbouring elements in the array, e.g. two fingers in each case with intervening photoconductive material, are biased with reciprocal polarity. For this purpose hitherto different possibilities for decoupling the individual elements of the array have been provided.

In the article by Saeedkia et al. "Analyses and Design of a Continuous-Wafer Terahertz Photoconductive Photomixer Array Source", IEEE TRANSACTIONS ON ANTENNA AND PROPAGATION, Vol. 53, No. 12, December 2005, the possibility of location-dependent modulation of the optical excitation by means of frequency mixing of two lasers is described. The optical intensity modulation achieved by frequency mixing generates charge carriers emitting THz radiation only in those antenna structures or antennae as elements of the array in which the charge carriers are subject to an electric field in the same direction. This ensures constructive interference in the THz distant field. This, however, presupposes that the optical excitation modulation is adapted as accurately as possible to the arrangement of the THz antennae in the THz antenna array. For this reason this method proves to be comparatively inflexible, costly and susceptible to error. Moreover, additional components for frequency mixing are needed. The same applies to approaches which use the generation of a binary grid for excitation modulation.

In the article by Dreyhaupt et al. "High-intensity terahertz radiation from a microstructured large-area photoconductor" in APPLIED PHYSICS LETTERS 86, 121114 (2005), this disadvantage is eliminated in that the optical excitation in certain regions between the THz antennae in a THz antenna array is suppressed by optically absorbent materials. In this case THz-emitting charge carriers can be generated optically only in those regions of the THz antenna array in which they are subject to an electric field in the same direction. The photoconductive material generally present between all neighbouring electrodes—the substrate usually—is covered by optically absorbent material placed on top of it. A disadvantage of this is that the production of such structures is comparatively costly since among other things two additional layers of material for optically blocking off suitable regions of the THz antenna array have to be deposited—this at least involves an electric insulation layer for insulating the electrodes of neighbouring THz antennae and deposited on top of this a layer impermeable to light which usually takes the form of a metal layer. An illustration in cross-section of such a THz antenna array is shown in FIG. 1. The additional optically screening layers identified there may generally adversely affect the performance of the antenna arrangement. It has been shown that the dark current is comparatively high since as a rule more than 50% of the total dark current is generated in the screened regions of the THz antenna array. This results in higher energy consumption by the THz antenna array in the case of a THz emitter or in lower sensitivity in the case of a THz detector. Moreover, the production of such an array has proved to be comparatively costly.

A simplified structure and simplified production of a THz antenna array of the type identified at the outset would be desirable.

SUMMARY OF THE INVENTION

This is where the invention comes in, whose object is to specify a THz antenna array and a method for producing it which has improved properties and in particular is simplified with respect to known arrays and production methods.

The task with regard to the THz antenna array is solved by the invention by means of the THz antenna array of the type identified at the outset in which according to the invention a lateral region between neighbouring THz antennae in the array is constructed to be practically non-photoconductive, i.e. photoconduction as in a region of a THz antenna cannot occur or is negligibly small. In particular it is provided for this purpose that a lateral region between neighbouring THz antennae in the array is practically free of photoconductive material. In other words, neighbouring THz-active elements in the array, i.e. THz antennae or structures, are inherently insulated from one another with regard to photoconduction. This is at variance with customary structures of the type explained at the outset in which regions between neighbouring THz-active elements are also photoconductive.

The task with regard to the production method is solved by the invention by means of a production method of the type identified at the outset in which according to the invention:

- a starting material having a photoconductive region is prepared;
- the electrodes are constructed on the photoconductive region;
- a lateral region between neighbouring THz antennae in the array is constructed to be non-photoconductive by removing a portion of the photoconductive region in the lateral region between neighbouring THz antennae in the array;
- the structure of the THz antenna array obtained in this way is lifted off from the starting material and transferred onto a substrate.

Accordingly, the concept of the invention provides direct decoupling of the THz-active elements in the array, that is to say the THz antennae or THz antenna structures, according to which a lateral region between neighbouring THz antennae in the array are of practically non-photoconductive structure. In doing this the invention has recognised that optical generation of photoconductive charge carriers in the lateral region between neighbouring THz antennae in the array is intrinsically impossible or negligibly small so that in these regions inherently no emission of THz radiation can occur which could contribute to destructive distant field interference. By this means additional measures for antennae decoupling, such as location-dependent modulation of the optical excitation, whether done by binary grids, frequency mixing or optical blocking of the lateral regions between neighbouring THz antennae, are rendered unnecessary. In pursuit of this consideration the invention provides that a portion of the photoconductive region in the lateral region between neighbouring THz antennae in the array is removed, in particular completely removed. A corresponding THz antenna array exhibits in the latter case especially a photoconductive region which is restricted to a lateral extension which does not substantially go beyond the lateral extension of the spacing region or beyond the lateral extension of the spacing region and the electrodes. The THz antenna arrays provided according to the inventive idea and the corresponding production method inventively utilise the principle of the epitaxial lift-off method using comparatively thin photoconductive films. Accordingly, the structures emitting or detecting THz radiation forming elements of the array according to the concept of the invention can be adapted particularly flexibly and at low cost and without additional components to the most varied optical systems having full-surface optical excitation. It has been shown that the emission power or detection sensitivity is optimised in comparison with hitherto known THz antenna arrays. It has been shown that a THz antenna array according to the concept of the invention usually exhibits dark current reduced by at least 50% which additionally increases the consumption or sensitivity of a detector. Moreover, the disadvantages of the state of the art identified at the outset are largely avoided. If within the framework of special applications it should nevertheless be required to have additional location-dependent modulation of the optical excitation the proposed concept affords the advantage of an enlarged tolerance range for fine adjustment of a frequency-mixing optical excitation or a binary grid. Additional optically screening layers of material are not necessary as a rule. Production of the THz antenna array according to the concept of the invention can be carried out particularly effectively and at low cost.

Advantageous refinements of the invention may be gathered from the subsidiary claims and specify in detail advantageous possibilities for implementing the concept explained above within the framework of the task set as well as with regard to further advantages.

It has been shown that on account of the epitaxial lift-off method preferably employed in the production process for lifting off a processed structure of a THz antenna array from the starting material a semiconductor material is no longer essential in principle for the support substrate. Within the framework of refinements support substrates can be employed which possess properties optimised for an appropriate application. In particular it has proved to be advantageous for a lateral region between neighbouring THz antennae in the array to be comparatively low in absorption and/or dispersion in the THz frequency range. Furthermore, a lateral region between neighbouring THz antennae in the array may also be constructed to be optically transparent and/or non-conducting. Electrical losses or dispersion effects can advantageously be largely avoided both in the THz frequency range and in the optical range. It has proved particularly advantageous in this context for the lateral region between neighbouring THz antenna arrays to be formed by a substrate, in particular by a sapphire or quartz glass substrate. Insofar as the substrate need not necessarily be optically transparent undoped silicon, for example, is also suitable since this has relatively low absorption and/or dispersion in the THz range.

Preferably the lateral region between neighbouring THz antennae—in particular at a deposition level of the photoconductive region and/or the electrodes—is free of material, i.e. a lateral region between neighbouring THz antennae in the array is removed practically completely in the course of the production process.

A THz antenna array according to the concept, in particular according to said refinements, of the invention are advantageously designed to be optimised for collective pulse-based optical excitation in the photoconductive region, preferably—depending on the photoconductive material—at an energy greater than 0.9 eV. Optical excitation preferably ensues by means of a femtosecond laser pulse, in particular in a wavelength range between 650 nm to 1200 nm, preferably between 750 nm and 850 nm. A THz antenna is formed in particular by means of a metal-semiconductor-metal structure (MSM structure) in which the electrodes are formed from metal and the photoconductive region from semiconductor. The photoconductive region is particularly advantageously formed from LT-GaAs. By this means the properties of the conduction carriers in the photoconductive region relevant for THz radiation emission or detection are particularly advantageously adjustable.

Moreover, within the framework of the concept of the invention different advantageous geometries for a THz antenna in said THz antenna array have been found.

In a particularly preferred first variant the photoconductive region has at least one photoconductive layer arranged underneath the electrodes, in particular a layer which extends over the lateral extension of the spacing region and the electrodes.

In addition or as an alternative, in a particularly preferred second variant of the photoconductive region has at least one photoconductive layer, possibly arranged only between the electrodes, in particular a layer which if need be extends only over the lateral extension of the spacing region.

It has, moreover, been shown that the photoconductive region is advantageously limited to a thickness of 10 μm, preferably 5 μm, preferably 2 μm, preferably 1 μm. In particular it has been shown that the photoconductive region advantageously has a thickness of at least 0.5 μm.

Within the framework of the concept of the invention THz antennae formed by electrodes in the form of a finger structure have proved to be particularly effective. In a particularly advantageous refinement of the invention a finger of the finger structure can have a geometry which contributes to the formation of a THz resonator. In this way resonant peaks in certain THz frequency ranges can be attained. Particularly advantageously the finger of the finger structure additionally has in its lateral extension a T-shaped geometry pointing away from the photoconductive region.

In another particularly preferred refinement of the invention a first plurality of THz antennae is at a different potential with respect to a second plurality of THz antennae. This opens up an additional possibility of emission modulation by control of the potential of the THz antennae. In this particularly preferred refinement the invention also results in a system composed of a plurality of THz antenna arrays of the type explained above in which at least a first plurality of THz antenna arrays is at a different potential with respect to a second plurality of THz antenna arrays.

Other advantageous refinements of the THz antenna arrays may be gathered from the other subsidiary claims and primarily serve to increase efficiency. This is achievable by different measures alone or in combination in the array design and/or antenna design, improving optical excitation and functionalisation of the layers and/or surfaces of the THz antenna array and/or the THz antennae. Preferably a spacing of the THz antennae is chosen to be comparatively large, in particular $\lambda/2$. A microlens or microlens array may be provided for focusing and directing the optical excitation. A functionalised arrangement of nanoparticles of high dielectric constant may serve to amplify the field.

With regard to the production method, advantageous refinements of the invention may be gathered from the subsidiary claims and specify in detail advantageous possibilities for implementing the concept explained within the framework of the object set and with regard to further advantages.

In a first preferred refinement of the invention in the course of constructing the electrodes metal layers can be deposited by vapour deposition and unwanted electrode areas can be lifted off. In a second alternative or additional refinement the structuring of the electrodes may also be done by chemical etching of unwanted electrode areas.

Preferably the photoconductive region is limited to a lateral extension which does not substantially go beyond the lateral extension of the spacing region or beyond the lateral extension of the spacing region and the electrodes. The removal of the portion of the photoconductive region preferably ensues by means of chemical etching of a lateral region between neighbouring THz antennae in the array.

The lifting off of the structure of the THz antenna array produced in this way from the starting material is advantageously done by chemically etching a sacrificial region below the photoconductive region.

Other preferred production steps may be gathered from the subsidiary claims and advantageously serve to increase efficiency.

Exemplified embodiments of the invention are now described below with reference to the drawing and with respect to the state of the art which is likewise illustrated in part. This is not intended to present the exemplified embodiments in substantial detail, rather the drawing is executed for explanatory purposes in schematic and/or slightly distorted form. With regard to supplementing the teachings directly discernible from the drawing we refer to the pertinent state of the art.

At the same time it should be borne in mind that numerous modifications and alterations relating to form and details of an embodiment can be carried out without departing from the general idea of the invention. The characteristics of the invention disclosed in the above description, in the drawing and in the claims both singly and in any combination may be essential for refining the invention. The general idea of the invention is not limited to the exact form or detail of the embodiment shown and described below or limited to a subject matter which would be restricted with respect to the subject matter claimed in the claims. In the case of specified dimensional ranges values lying within said limits are also disclosed as limiting values and are usable and claimable in any way.

BRIEF DESCRIPTION OF THE DRAWINGS

For deeper comprehension of the invention preferred embodiments of the invention are now explained with reference to the figures in the drawing. The drawing shows.

DETAILED DESCRIPTION OF THE PREFERRED EMBODIMENTS(S)

Figure 1:
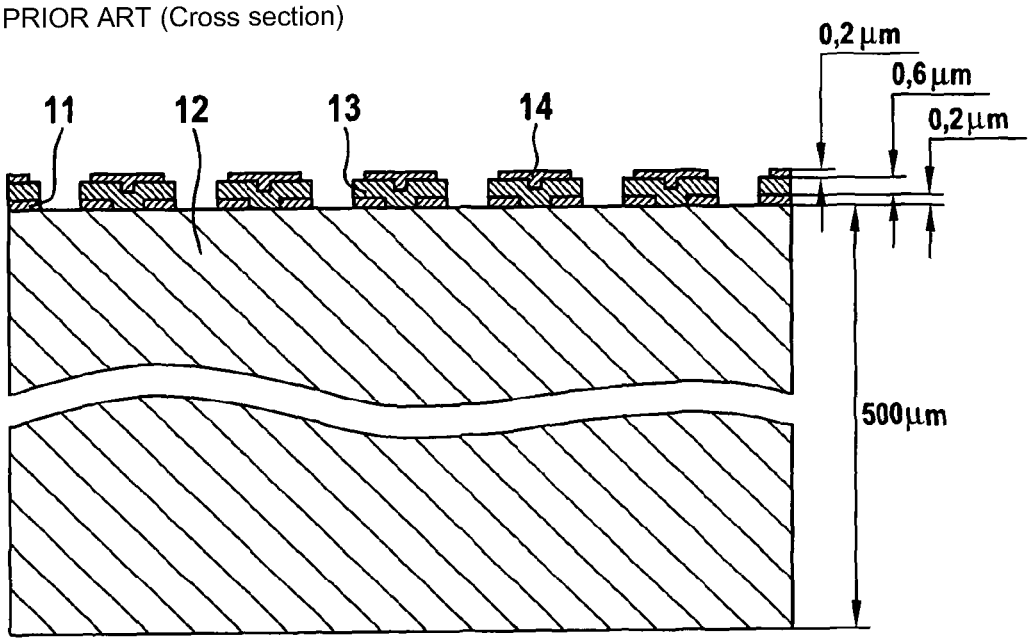
FIG. 1 a THz antenna array in cross-section as described in the article by Dreyhaupt et al. identified at the outset.

FIG. 1 shows a schematic cross-sectional illustration of a known THz emitter according to the article by Dreyhaupt et al. identified at the outset. Two intermeshing finger electrodes 11 are processed by optical lithography on the surface of a semiconductive GaAs wafer 12. The spacings of the fingers of the finger electrode 11 amount to 5 μm. The metallisation of a finger electrode 11 consists of 5 nm of chromium and 200 nm of gold. Another opaque metallised layer in the form of an optically [non-?]transparent metal layer 14 composed of chromium-gold covers each second finger electrode spacing. This second metal layer 14 is insulated from the first metal layer of the finger electrode 11 by an insulating layer 13 in the form of a polyimide layer approximately 2 μm thick or a silicon oxide layer 560 nm thick. The substrate in the form of the GaAs wafer 12 has a thickness of approximately 500 μm.

When the finger electrodes are biased the electric field direction between successive fingers of the finger electrodes 11 is reversed. Due to the second opaque and optically non-transparent metal layer 14 on the respective finger electrodes 11 optical excitation takes place only in those fundamentally completely photoconductive regions of the photoconductive substrate 12 which exhibit the same field direction. Thus, after optical excitation the photoconductive carriers generated only in some regions are accelerated unidirectionally over the entire optically excited region of the completely photoconductive substrate so that the THz radiation emitted by the photoconductive substrate 12 interferes constructively in the distant field.

To avoid the coatings 13, 14 additionally required in FIG. 1—in particular to achieve a simpler preparation of a THz antenna array and a correspondingly simplified production method—the concept of the invention provides a THz antenna array 20, 30, 40 in which a lateral region between neighbouring THz antennae is of is of practically non-photoconductive construction, i.e. photoconduction as in a region of a THz antenna cannot occur or is negligibly small. As described in FIG. 1 to FIG. 8, this is achieved in that a lateral region between neighbouring THz antennae is free of photoconductive material.

Figure 2:
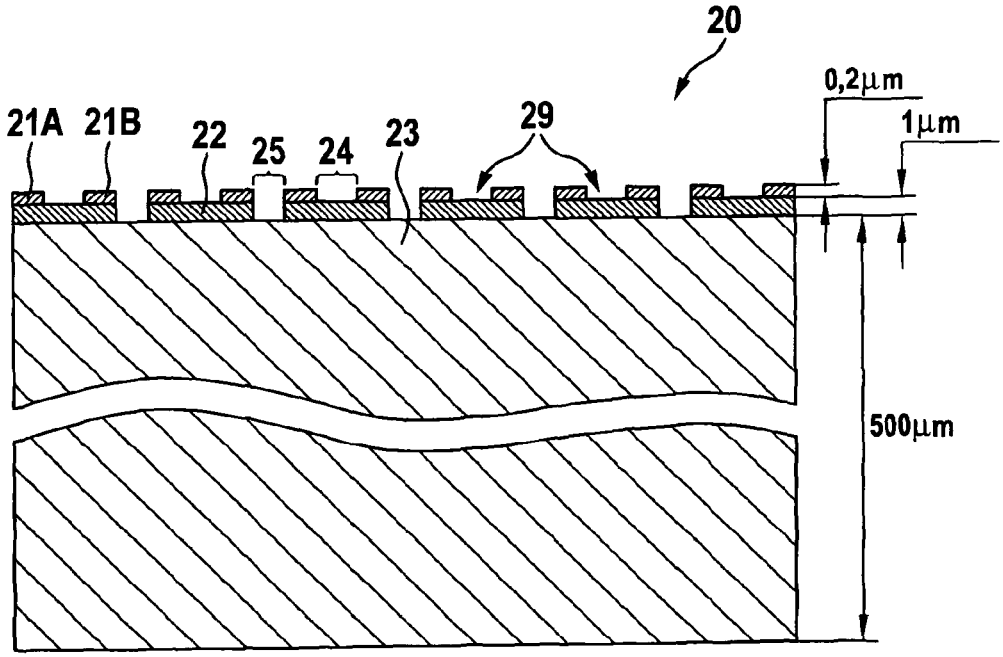
FIG. 2 a first embodiment of a THz antenna array according to the concept of the invention in cross-section.

A first preferred embodiment according to this concept is shown in FIG. 2. FIG. 2 shows a THz antenna array 20 in cross-section having a plurality of THz antennae 29, wherein a THz antenna 29 comprises a photoconductive region 22 and a first electrode 21A and a second electrode 21B. The electrodes 21A, 21B are arranged spaced apart by a spacing region 24 which extends laterally over at least a portion of the photoconductive region 22. According to the concept of the invention the lateral region 25 between neighbouring THz antennae 22 in the array 20 is of non-photoconductive construction. The present embodiment provides no photoconductive material in the region 25. In this case the photoconductive region 22 is restricted to a lateral extension which does not go beyond the lateral extension of the spacing region 24 and the electrodes 21A, 21B. The photoconductive region is formed from LT-GaAs which has a low charge carrier lifetime advantageous for THz emission. This is an additional advantage over the GaAs substrate usually used for the photoconductive material which in comparison with LT-GaAs has a comparatively high charge carrier lifetime and comparatively disadvantageous dispersion and damping properties. The thickness of the electrodes 21A, 21B is approximately 200 nm. The thickness of the photoconductive region is approximately 1,000 nm and hence is distinctly less than photoconductive layers commonly used. The thickness of the substrate is in the region of 500 μm. In the embodiment shown in FIG. 2 the substrate is constructed as an optically transparent, non-conductive substrate in the form of a sapphire substrate 23. This exhibits particularly low dispersion and damping both in the THz and optical frequency range.

Figure 3:
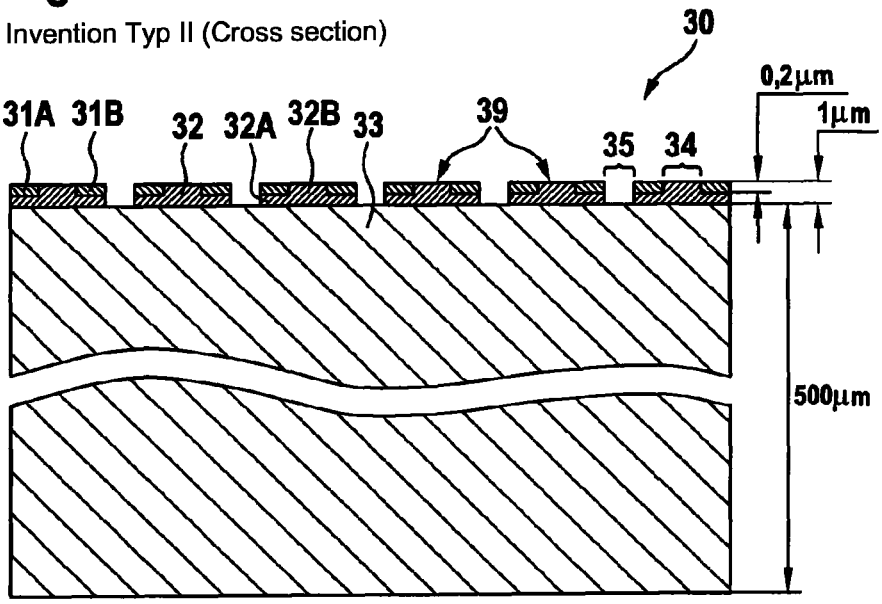
FIG. 3 a second embodiment of a THz antenna array according to the concept of the invention in cross-section.

FIG. 3 shows another particularly preferred embodiment of a THz antenna array 30 again with a plurality of THz antennae, wherein a THz antenna 39 comprises a photoconductive region 32 and a first electrode 31A and a second electrode 31B which are arranged spaced apart by a spacing region 34 which extends laterally over at least a portion of the photoconductive region 32. The THz antennae 39 are set up on an undoped silicon substrate 33. The thicknesses of the layers are constructed similar to those in FIG. 2.0

In the embodiment shown in FIG. 3 the electrodes 31A, 31B are "sunken". At variance with the embodiment shown in FIG. 2 the photoconductive region 34 in addition to the layer 32A arranged as in FIG. 2 below the electrodes 31A, 31B and extending over the lateral extension of the spacing region 34 and the electrodes 31A, 31B has another photoconductive layer 32B. The photoconductive region also has a layer 32B arranged between the electrodes 31A, 31B which in this case extends only over the lateral extension of the spacing region 34.

Figure 4:
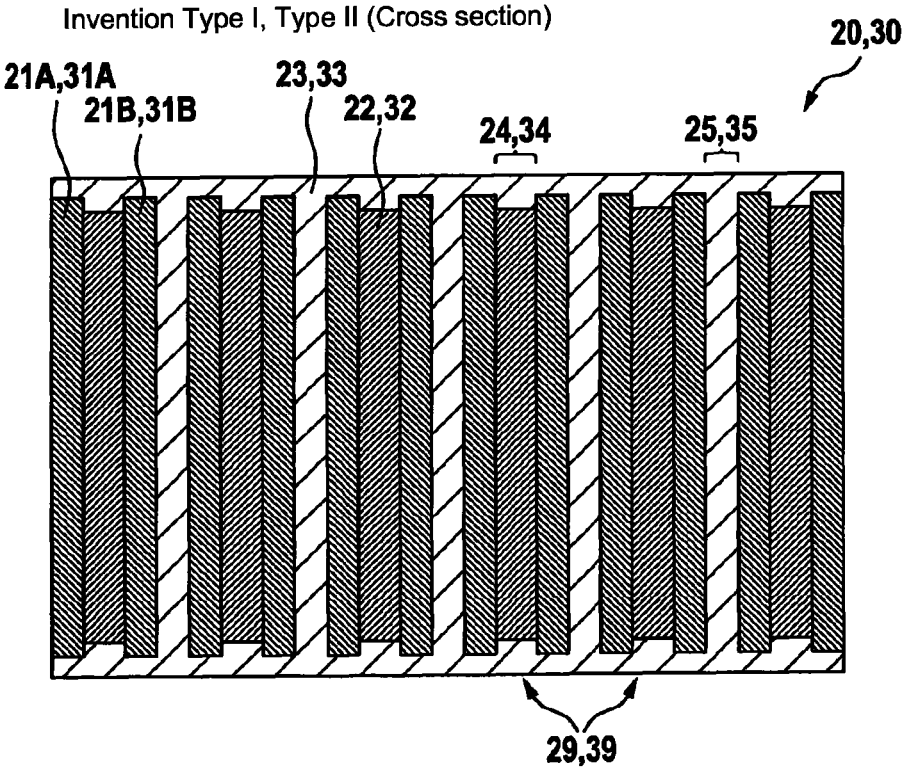
FIG. 4 a plan view onto the embodiment according to FIG. 2 and FIG. 3.

FIG. 4 shows in plan view the embodiments shown in cross-section in FIG. 2 and FIG. 3, the same reference symbols being used correspondingly. In this the finger structure of the electrodes 21A, 21B, 31A, 31B is evident.

Figure 5:
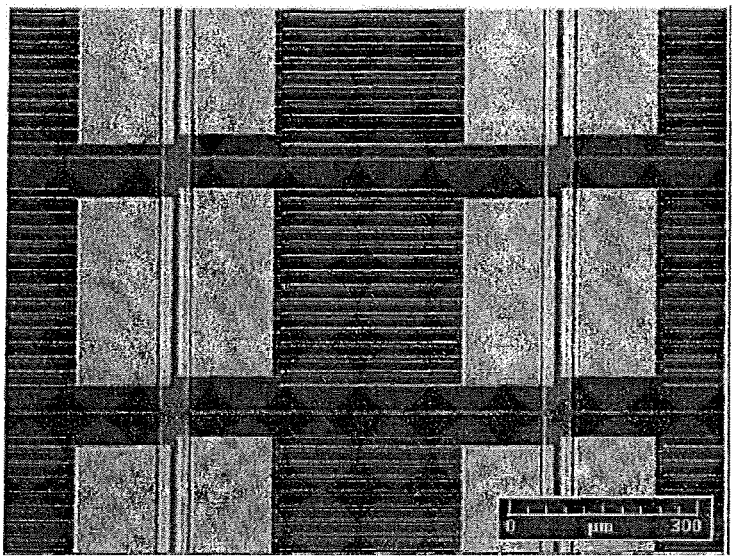
FIG. 5 a photomicrograph of structures for THz antenna arrays according to the concept of the invention prior to epitaxial lift-off from the semiconductor starting material.

FIG. 5 shows a photomicrograph of a structure for a THz antenna array according to the embodiment illustrated in FIG. 2, i.e. the THz antenna array before the epitaxial lift-off from the starting material on an appropriate scale.

In the production method the starting material is made ready as shown schematically in FIG. 8*a*. In this case this is a GaAs substrate 51 having an epitaxially applied heterostructure layer composed of 100 nm of GaAs (not shown), 100 nm of AlAs 52 as the sacrificial layer and a layer 53 of LT-GaAs in the range of 500 to 2000 nm thick.

The structuring of the electrodes shown in FIG. 8*b* in the form of a finger structure 54 can be carried out on the one hand by spinning on a photosensitive coating followed by lithography. This is followed by metal vapour deposition of the electrode material and then lift-off of the unwanted metal surface by dissolving the photosensitive coating in acetone. In another procedure the metal vapour deposition can be done first and then spinning on the photosensitive coating followed by lithography. This is followed by wet-chemical etching of the unwanted metal electrode areas.

In the stage of the method shown in FIG. 5 a photosensitive coating has additionally been spun on followed by lithography. After this the LT-GaAs lateral regions between neighbouring THz antennae in the array have been etched away as shown in FIG. 8*c* by wet-chemical or dry-chemical means.

As shown in FIG. 8*d* epitaxial lift-off of the entire antenna array structure 52 shown in FIG. 5 ensues by wet-chemical etching of the AlAs sacrificial layer, in hydrofluoric acid for example.

Figure 6:
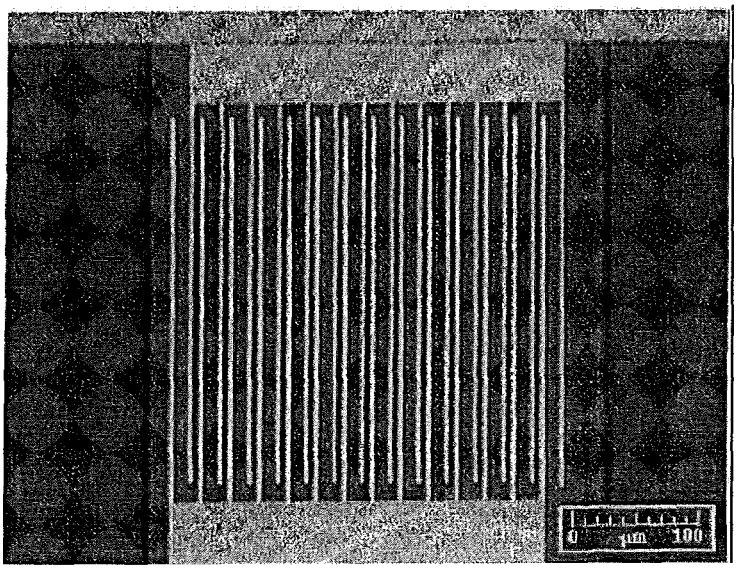
FIG. 6 the structures in FIG. 5 as THz antenna arrays after transfer to an optically transparent substrate.

In FIG. 6 the THz antenna array in FIG. 5 is shown after the transfer illustrated in FIG. 8*e* on a support substrate 55 that is not designated in more detail. This may be undoped silicon which exhibits comparatively little absorption and dispersion in the THz range or optionally also and additionally optically transparent substrate such as sapphire or quartz glass. The finished THz antenna array at the end of the production process is illustrated in FIG. 8*f*.

The photomicrographs shown in FIG. 5 and FIG. 6 are details. Comparatively high piece numbers are achieved in production in that a large number of antenna arrays are processed in parallel on a GaAs starting substrate 51.

Figure 7:
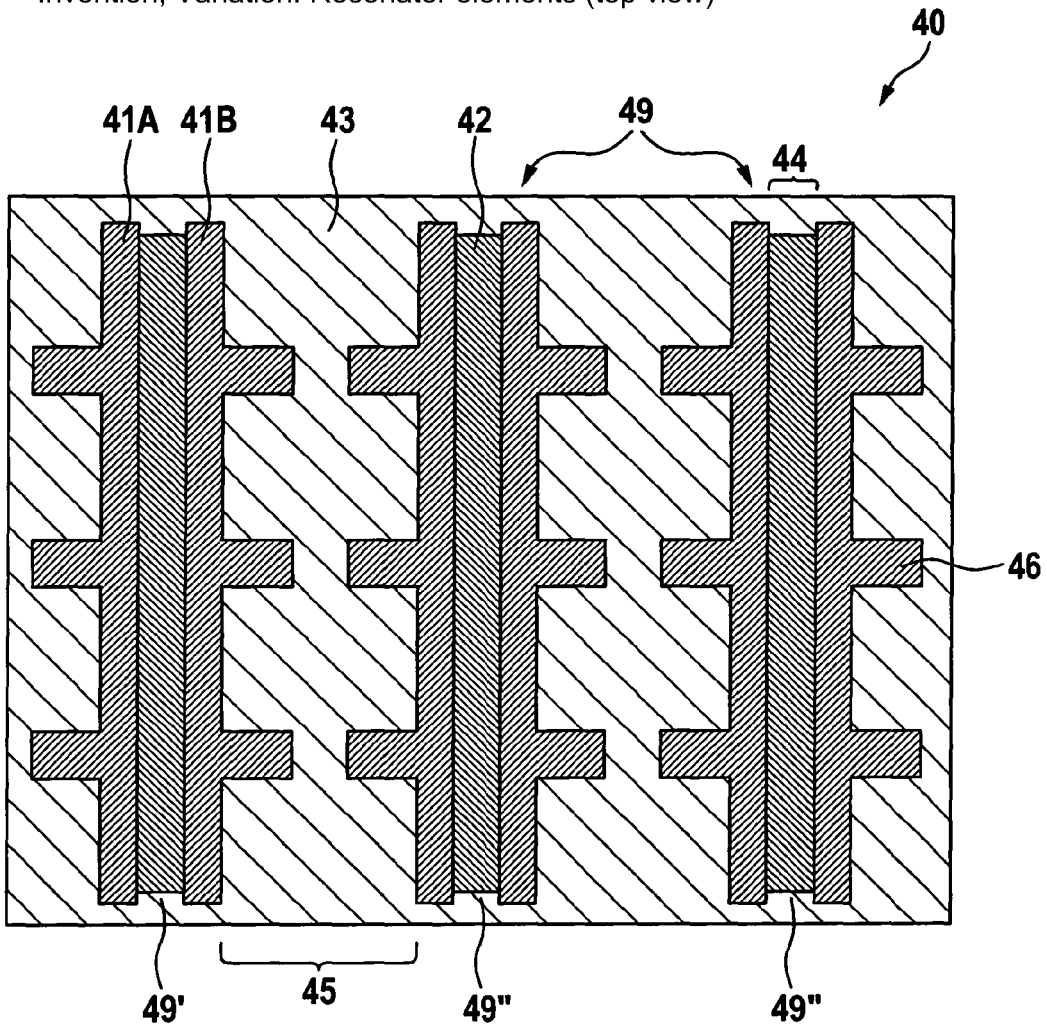
FIG. 7 a plan view onto another embodiment of a THz antenna array for forming resonator elements.
Figure 8:
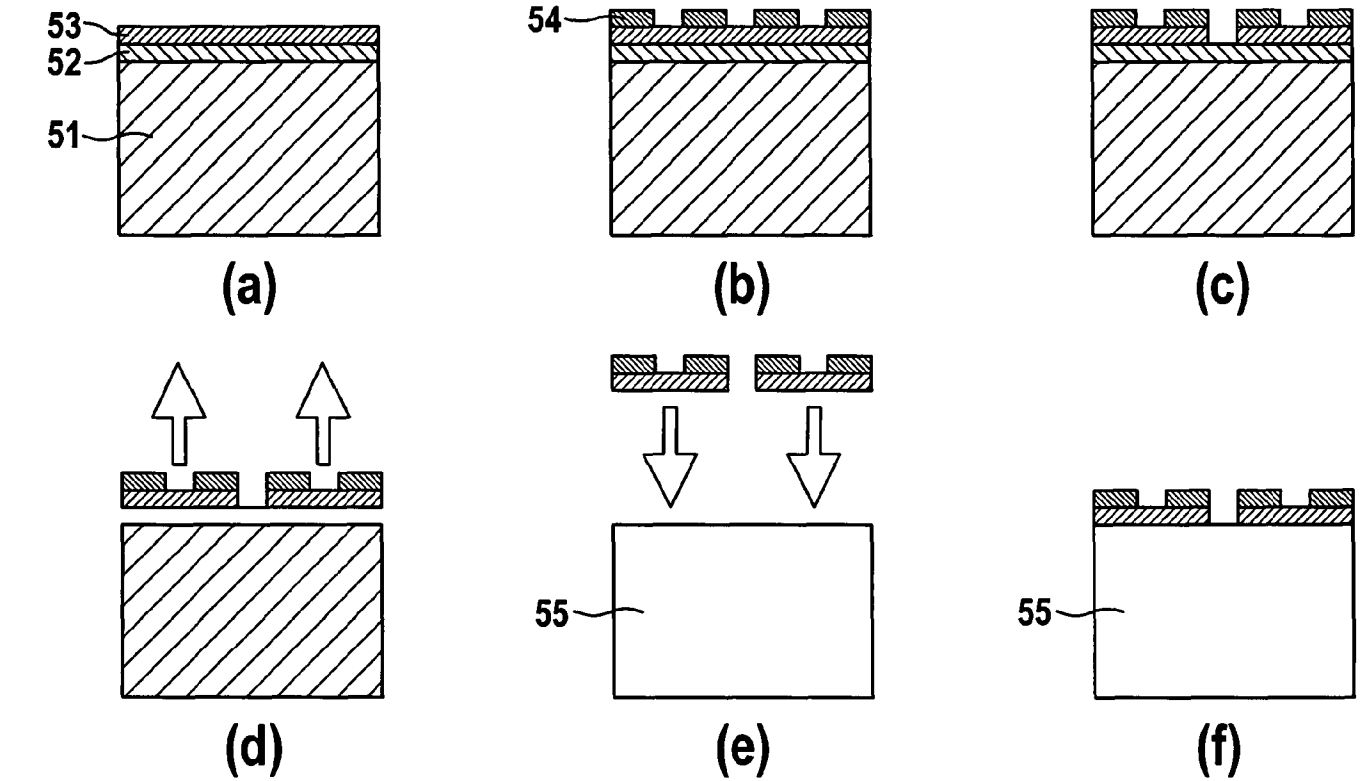
FIG. 8 a schematic illustration of the production method for a preferred embodiment.

FIG. 7 shows another particularly preferred embodiment of a THz antenna array 40 according to the invention in schematic plan view similar to that in FIG. 4. Again the finger structure of the electrodes 41A, 41B with the intervening spacing region 44 is illustrated, this region extending laterally over at least a portion of the photoconductive region 42. The THz antennae 49 in the array 40 are set up on an undoped silicon substrate 43 according to the production method explained with reference to FIG. 5 and FIG. 6. The finger-like electrodes 41A, 41B of the finger structure exhibit in their lateral extension a T-shaped geometry 46 pointing away from the photoconductive region which contributes to the formation of a THz resonator, the square-like region 48 between the electrodes 41A, 41B.

Moreover, in a manner not illustrated in more detail a first plurality of THz antennae 49' can be set to a different potential with respect to a second plurality of THz antennae 49". As a result said resonators 46 can, inter alia, be controlled differently and/or the emission characteristics of the entire array be advantageously modulated.

Figure 9:
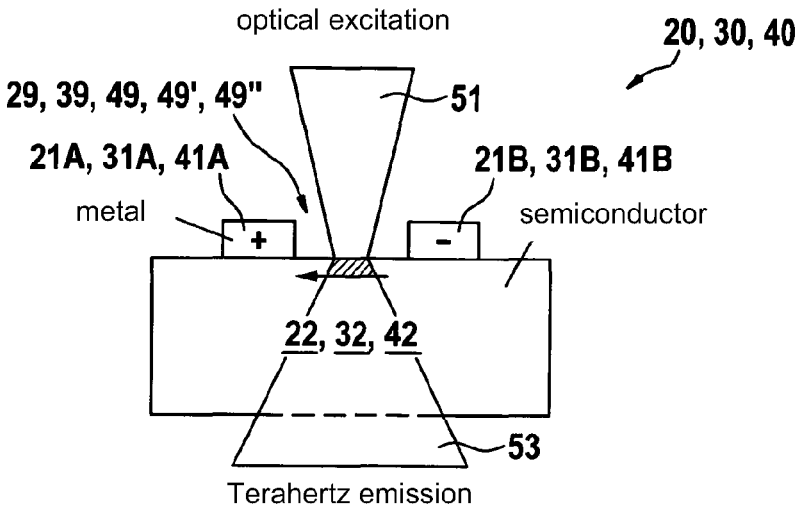
FIG. 9 a schematic illustration of the excitation and emission process for a preferred embodiment.
Figure 10:
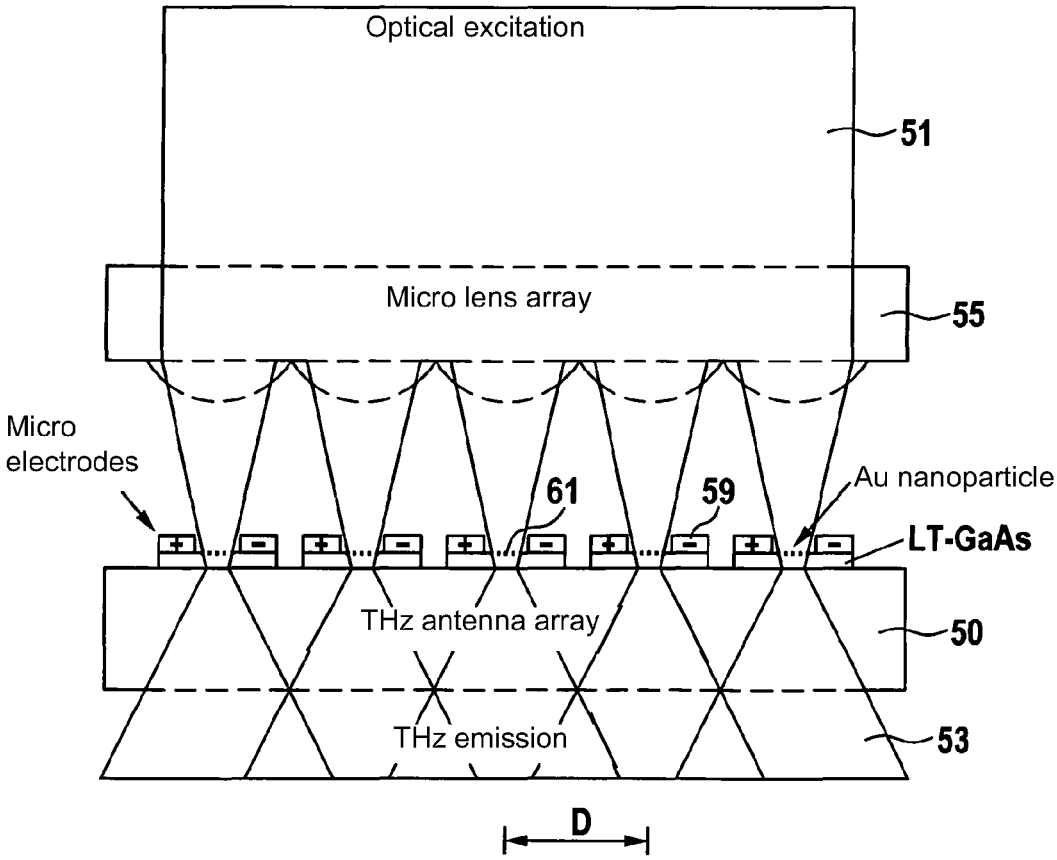
FIG. 10 a schematic illustration of the excitation and emission process for another preferred embodiment.
Figure 11:
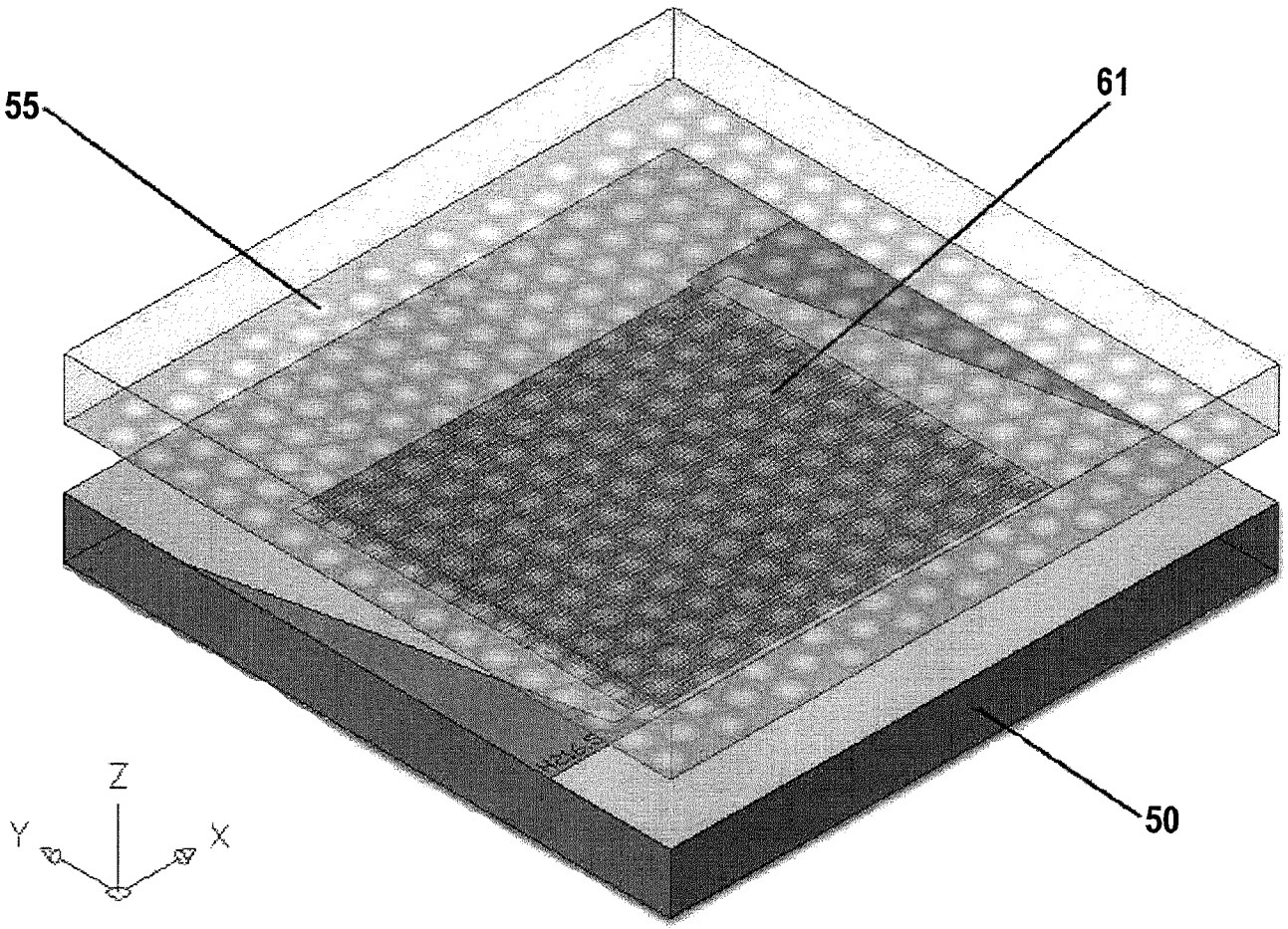
FIG. 11 the other preferred embodiment in a three-dimensional, semitransparent schematic illustration.

The described microtechnological approach relating to the production of the THz antenna arrays 20, 30, 40 described above can, moreover, can be improved by preferably at least an order of magnitude with reference to an achievable THz output signal power by using nanotechnology, photonics and microsystem methods, this having only a negligible effect on production costs. For this purpose FIG. 9 shows a schematic illustration of the THz antenna array 20, 30, 40 described above—in this case in detail a THz antenna 29, 39, 49, 49', 49" of the same in an optical excitation shown shaded, in particular in the photoconductive region 22, 32, 42 which is already focused according to the improvement between the first electrode 21A, 31A, 41A and the second electrode 21B, 31B, 41B and results in a lightly drawn THz emission 53 downwardly through the THz-transparent substrate which is not illustrated in more detail, i.e. coming from the excitation side in the transmission direction. This refined concept of a focused optical excitation can be achieved by an arrangement, not illustrated here in more detail, of a microlens on the excitation side relative to the THz antenna. By enlarging the spacing of two neighbouring THz antennae not shown in more detail in FIG. 9, for example as here in the form of a metal-semiconductor-metal arrangement (MSM antenna), to a length of $\lambda_2$ ($\lambda$/2?) with respect to the THz wavelength the gain of a THz antenna array can be considerably improved. These and other improvements are shown in FIG. 10 and FIG. 11 and relate firstly to component design, secondly to optical excitation and thirdly to increasing efficiency by functionalising the semiconductor surface with the aid of metallic nanoparticles. These are implemented in the present case in another preferred embodiment of a THz antenna array 50 and exploit in improved fashion the potential of classical field theory for antenna arrays. In the case in hand by enlarging the spacing D of individual MSM antenna elements 59, for example those illustrated in FIG. 9 or in the previous figures, from $\lambda$/20, for example, to a length of $\lambda$/2 with respect to the wavelength of the THz radiation, the gain of the arrangement of the THz antenna array can be considerably improved as a result of which the optical losses in the surrounding total system are markedly reduced. The gain also depends on the electromagnetic coupling of the individual antennae 59 which can likewise be improved by advantageous measures such as refractive index adaptations or the like. Due to the measure of enlarging the spacing D of individual MSM antenna elements 59 identified above the gain can if need be be increased by up to an order of magnitude or more.

Enlarging the antenna spacing D also possibly means an enlargement of inactive intermediate surfaces, i.e. an enlargement of the spacing regions 24, 34, 44 as described in the preceding figures. Pursuing the concept explained in FIG. 9 of focusing with the aid of a microlens, in the embodiment of a THz antenna array 50 illustrated in FIG. 10 a microlens array 55 is integrated on the excitation side above a THz antenna 59 in the THz antenna array 50 and the component encompassing the microlens array 55. The microlens array 55 focuses the optical excitation 51 in the form of the optical excitation beam onto the repeating arrangement of antennae 59 in the THz antenna array. In this way it is possible as illustrated in FIG. 10 to illuminate only active regions, i.e. spacing regions 24, 34, 44 as illustrated in the preceding figures and in this way to utilise the optical excitation energy more efficiently. For this purpose a microlens array specially provided on the THz antenna array 50 can be designed which match the required antenna spacing D. It has, furthermore, been shown that when focusing the optical excitation 51 onto the spacing region 24, 34, 44 between the electrodes 21A, 31A, 41A, on the one hand, and 21B, 31B, 41B, on the other hand, it becomes possible to design the actual area needed for focusing so that it is smaller than the extension of the spacing region 24, 34, 44. It has also turned out that due to this type of focusing of the optical excitation 51 below the extension of the spacing region charge carriers generated in the spacing region 24, 34, 44 have a larger volume available to them and hence screening effects are reduced, which in turn results in an increase in efficiency. It may also be advantageous to set up the optical focusing more in proximity to the anode than centrally or even focusing close to the cathode since by this means also screening effects are kept comparatively lower and hence the efficiency of a THz emission can be raised. Another improvement in generating the THz signal can be achieved, as in the present case in the course of a modification of the semiconductor surface for example, in the form of a deposited layer consisting gold nanoparticles separated from one another. Metallic and other materials having a high dielectric constant in the form of particles having diameters in the range of a few nanometers are used in the present case not only to increase the sensor surface but also for influencing the field dynamics of the charge carriers generated by the optical excitation. Specifically in this case due to the excitation a surface plasmon resonance is obtained and as a function of particle size and density different absorption properties can be produced. In the immediate vicinity of such metallic nanoparticles high field strengths occur in the event of plasmonic excitation which can be used, for example, for increasing the sensitivity of the present THz antenna array. In the case in hand it has been recognised in this refinement that the optical Plasmon resonance properties of the metallic nanoparticles in the layer 61 can be used for raising conversion efficiency. In the present case this serves to increase the photoconductive efficiency of the THz array 50 designed as an emitter or also to increase the sensitivity of a photoconductive detector. A three-dimensional illustration of the THz antenna array 50 in FIG. 10 is shown in FIG. 11. The microlens array 55 can as explained be integrated with the THz antenna array 50 to form a THz emitting component. In the present case an arrangement of THz antennae in the form of a finger structure is illustrated schematically in FIG. 11. and above it in extrapolated position the nanoscale functionalised surface 61.

Figure 12:
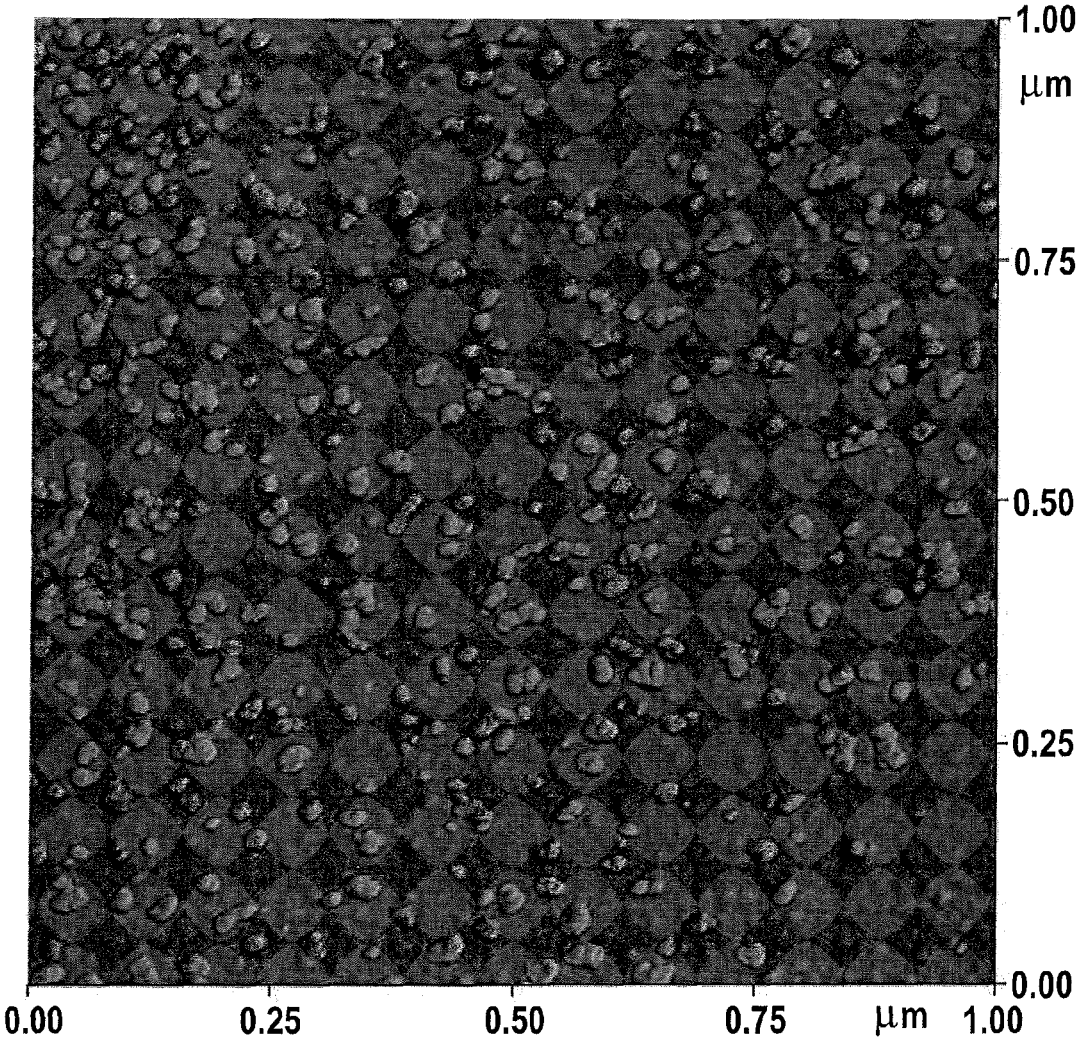
FIG. 12 a typical version of a functionalised surface of a THz antenna array with nanoparticles as an AFM photograph.

In the present case such a surface 61 can be obtained as a low-cost process, e.g. in the course of depositing gold nanoparticles on a $SiO_2$ surface. Such an example is illustrated in FIG. 12. With the aid of an electron beam vaporisation process gold particles having a height of 2 nanometers and a diameter of 3 to 6 nanometers are produced with an average spacing of about 20 nanometers. With regard to this FIG. 12 shows an AFM photograph showing the distinct separation of the Au particles which is particularly suitable to bring about the efficiency-enhancing effects of THz conversion in an emitter as shown, for example, in FIG. 9 or FIG. 10. For this purpose a THz antenna array as described in FIG. 1 to FIG. 8 can be used.

The invention claimed is:

1. A THz antenna array having a plurality of THz antennae, wherein a THz antenna comprises a photoconductive region, a first electrode and a second electrode, said first and second electrodes being arranged spaced apart by a spacing region which extends laterally over at least a portion of the photoconductive region, and a lateral region between neighbouring THz antennae being of practically non-photoconductive construction.

2. The THz antenna array according to claim 1, wherein the lateral region between neighbouring THz antennae is practically free of photoconductive material.

3. The THz antenna array according to claim 1, wherein the photoconductive region is limited to a lateral extension which does not go substantially beyond a lateral extension of the spacing region and the first and second electrodes.

4. The THz antenna array according to claim 1, wherein the lateral region between neighbouring THz antennae in the array is comparatively low in at least one of absorption and dispersion in the THz frequency range.

5. The THz antenna array according to claim 1, wherein the lateral region between neighbouring THz antennae in the array is at least one of optically transparent and non-conductive.

6. The THz antenna array according to claim 1, wherein the lateral region between neighbouring THz antennae is formed by means of a substrate.

7. The THz antenna array of claim 6, wherein said substrate is selected from the group consisting of a sapphire substrate and a quartz glass substrate.

8. The THz antenna array according to claim 1, wherein the lateral region between neighbouring THz antennae at a deposition level of the photoconductive region and/or the electrodes is free of material.

9. The THz antenna array according to claim 1, wherein the THz antennae are designed for collective, pulse-based, optical excitation in the photoconductive region at an energy above 0.9 eV, and a wavelength range between 650 nm to 1200 nm.

10. The THz antenna array of claim 9, wherein said wavelength is between 750 nm and 850 nm.

11. The THz antenna array according to claim 1, wherein the THz antenna is formed by means of a metal-semiconductor-metal structure in which the electrodes are formed by metal material and the photoconductive region by semiconductor material.

12. The THz antenna array according to claim 1, wherein the photoconductive region is formed by LT-GaAs.

13. The THz antenna array according to claim 1, wherein the photoconductive region comprises at least one layer arranged below the first and second electrodes and said at least one layer extending over a lateral extension of the spacing region and the first and second electrodes.

14. The THz antenna array according to claim 1, wherein the photoconductive region comprises at least one layer arranged between the first and second electrodes and said at least one layer extending over the lateral extension of the spacing region.

15. The THz antenna array according to claim 1, wherein the photoconductive region has a thickness in the range of from 0.5 μm to 10 μm.

16. The THz antenna array according to claim 1, wherein the electrodes are in the form of a finger structure.

17. The THz antenna array according to claim 16, wherein a finger of the finger structure has a geometry which contributes to the construction of a THz resonator.

18. The THz antenna array according to claim 17, wherein the finger of the finger structure in its lateral extension has a T-shaped geometry pointing away from the photoconductive region.

19. The THz antenna array according to claim 1, wherein a first group of the THz antennae is at a different potential with respect to a second group of the THz antennae.

20. The THz antenna array according to claim 1, wherein a spacing of neighbouring THz antennae measured with respect to the centers of the THz antennae is in the range between $\lambda/40$ and $\lambda/1.5$.

21. The THz antenna of claim 20, wherein the spacing is in the range between $\lambda/40$ and $\lambda/10$.

22. The THz antenna array according to claim 20, wherein the spacing is in the range between $\lambda/4$ and $\lambda/1.5$.

23. The THz antenna array according to claim 1, further comprising a microlens arranged on the excitation side above a THz antenna.

24. The THz antenna array according to claim 23, wherein the microlens comprises a microlens array arranged on the excitation side of a THz antenna and at least partially covering the THz antenna array.

25. The THz antenna array according to claim 24, wherein the microlens array completely covers the THz antenna array.

26. The THz antenna array according to claim 1, wherein a THz antenna comprises a field-amplifying means on the excitation side in and/or on the photoconductive region and in the spacing region.

27. The THz antenna array according to claim 26, wherein the field-amplifying means is formed by a nanoscale material of high dielectric constant.

28. The THz antenna array of claim 27, wherein said nanoscale material comprises a metallic material formed by a functional layer of metallic nanoparticles.

29. A system composed of a plurality of THz antenna arrays according to claim 1, wherein at least a first group of THz antenna arrays is at a different potential with respect to a second group of THz antenna arrays.

* * * * *